United States Patent [19]

Charlot, Jr. et al.

[11] Patent Number: 5,031,287

[45] Date of Patent: Jul. 16, 1991

[54] DETRIMENTAL-SUBSTANCE-CONTAINING THEFT-DETERRENT DEVICE

[75] Inventors: Lincoln H. Charlot, Jr., St. Petersburg; Carter W. Clarke, Jr., Clearwater, both of Fla.

[73] Assignee: Security Tag Systems, Inc., St. Petersburg, Fla.

[21] Appl. No.: 360,842

[22] Filed: Jun. 1, 1989

[51] Int. Cl.[5] ..... A44B 9/00

[52] U.S. Cl. ..... 24/704.1; 24/703.1; 70/57.1

[58] Field of Search ..... 24/704.1, 703.1, 703.3, 24/703.5, 706.8, 707.6, 572; 70/57.1

[56] References Cited

U.S. PATENT DOCUMENTS

| | | | |
|---|---|---|---|
| 3,858,280 | 1/1975 | Martens | 24/704.1 |
| 3,974,581 | 8/1976 | Marten et al. | 70/57.1 |
| 4,299,870 | 11/1981 | Humble | 70/57.1 |
| 4,311,992 | 1/1982 | DeChant | 70/57.1 |
| 4,481,428 | 11/1984 | Charlot, Jr. | 307/219.1 |
| 4,483,049 | 11/1984 | Gustavsson et al. | 70/57.1 |
| 4,590,461 | 5/1986 | Cooper | 70/57.1 |
| 4,649,397 | 3/1987 | Heaton et al. | 70/57.1 |
| 4,670,950 | 6/1987 | Wisecup et al. | 70/57.1 |

*Primary Examiner*—Victor N. Sakran
*Attorney, Agent, or Firm*—Edward W. Callan

[57] ABSTRACT

A device for deterring theft of a protected article, including a pin and clutch for attaching the device to the article, with the pin and clutch being embodied in two components that are adapted to be locked together on opposite sides of a portion of the protected article to prevent unauthorized removal of the device from the article. One component includes a plurality of fragile elongated vials that fracture when flexed longitudinally, with each vial containing a detrimental substance that would damage the article if the vial were to be fractured while the device was attached to the article. The vial-containing component is so structured as to include a plurality of regions in which the vial-containing component flexes more easily in a predetermined direction than in other directions and regions, with the predetermined direction of easier flexing being different in different said given regions; and the vials are respectively disposed within each of the given regions of the vial-containing component such that when any of the given regions of the vial-containing component is flexed in the predetermined direction of easier-flexing for said given region, the vial disposed in said region is flexed longitudinally and fractures to thereby release the substance contained therein. The other component is so structured as not to flex when the attempt is made to pry the vial-containing component from the other component while the two components are locked together, thereby concentrating flexure forces resulting from said prying in the vial-containing component.

26 Claims, 6 Drawing Sheets

FIG. 2
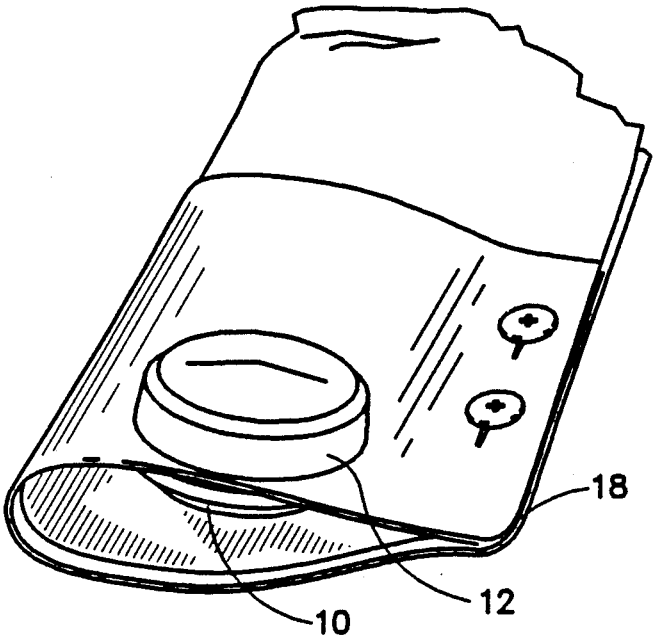
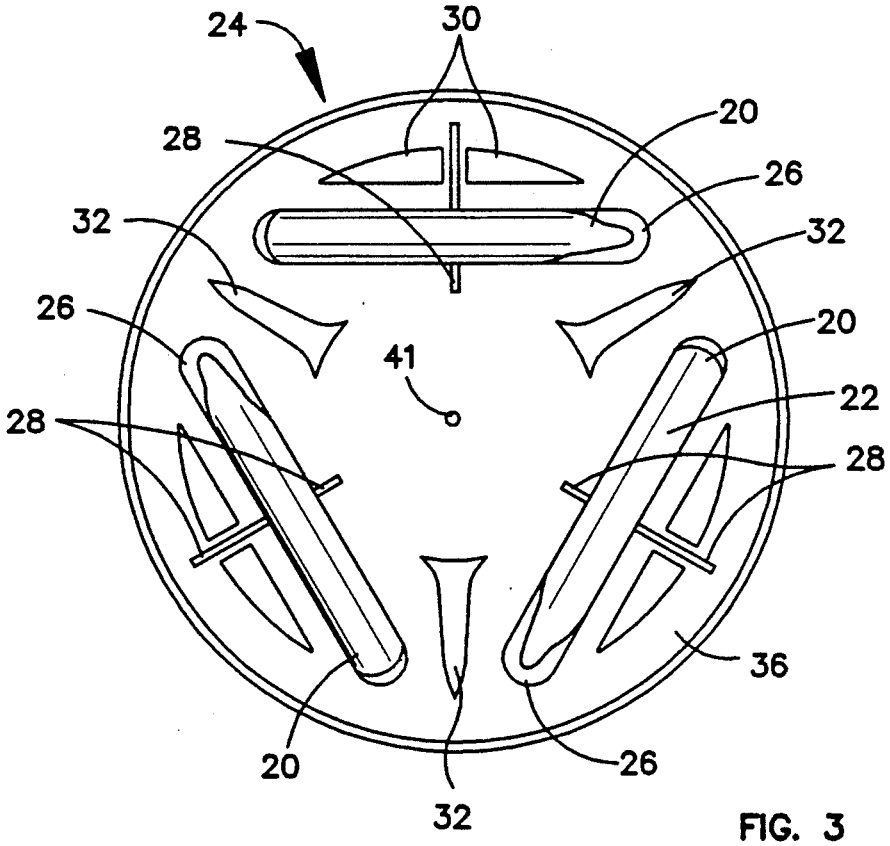
FIG. 3

FIG. 4
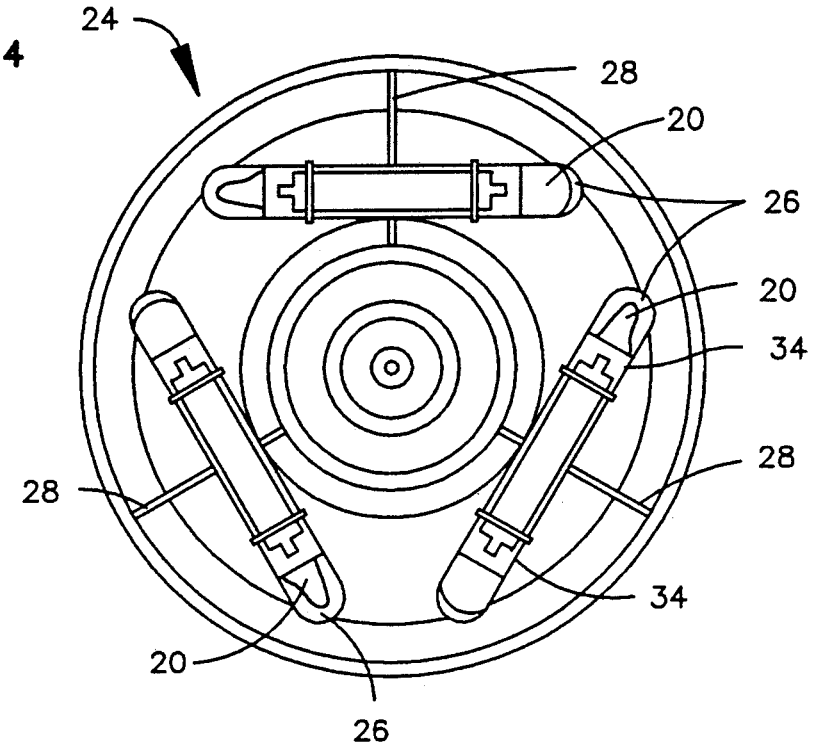
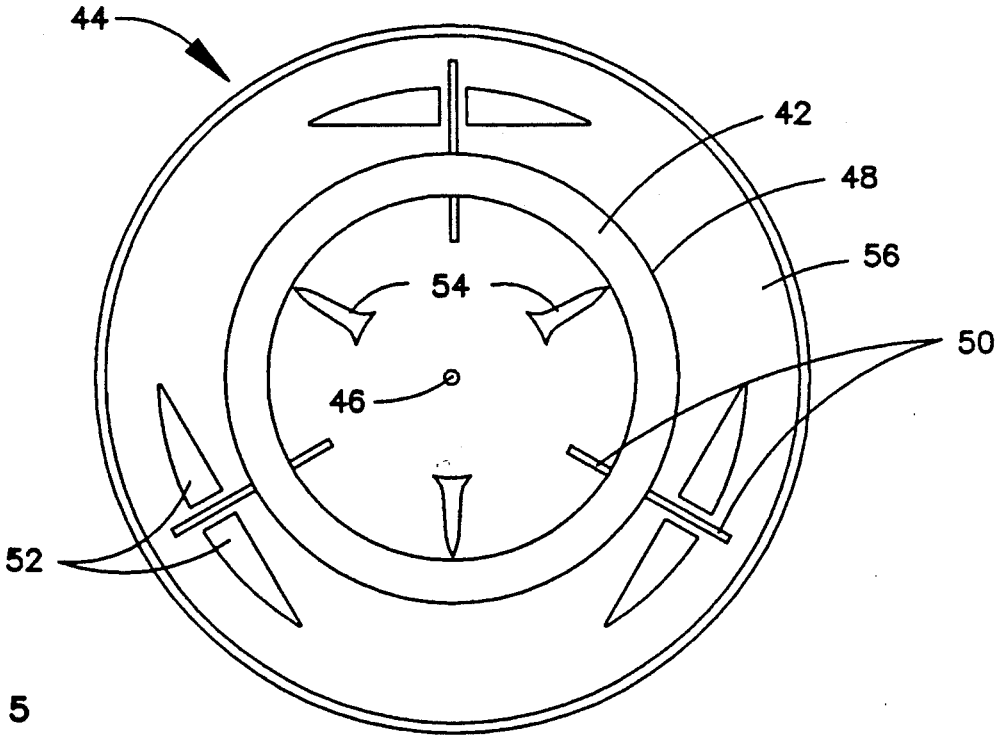
FIG. 5

DETRIMENTAL-SUBSTANCE-CONTAINING THEFT-DETERRENT DEVICE

BACKGROUND OF THE INVENTION

The present invention is generally directed to devices that may be attached to articles, such as merchandise, for deterring the theft of such articles, and is particularly directed to improvements in a theft-deterrent device of the type that contains a detrimental substance that damages a protected article attached to the device by releasing such substance when the device is tampered with during an unauthorized attempt to remove the device from the article.

Typically, the device includes means for attaching the device to the article, with the attaching means being embodied in two components that are adapted to be locked together on opposite sides of a portion of said article to prevent unauthorized removal of the device from the article. A typical attaching means includes a pin embodied in one of the two components and means embodied in the other component for receiving the pin. The device is attached to the protected article by passing the pin through a portion of the article. At least one of the two components includes a fragile elongated vial that fractures when flexed longitudinally, with said vial containing the detrimental substance that would damage the article if the vial were to be fracture while the device was attached to the article.

Prior art devices of this nature are described in U.S. Pat. Nos. 4,483,049 to Gustavsson et al., 4,670,950 to Wisecup et al. and 4,649,397 to Heaton et al. Typically, these devices are used to discourage the theft of such articles of merchandise as clothing, and the detrimental substance typically is an ink or dye or foul-smelling substance that permanently stains and or fouls the clothing so as to make the clothing unattractive and thereby generally unfit for wear.

In both the device described in U.S. Pat. No. 4,483,049 and the device described in U.S. Pat. No. 4,670,950, a detrimental substance is contained in two frangible vials that are respectively disposed in two opposing components that are secured together on opposite sides of a portion of the protected article when the device is locked to the article.

In the device described in U.S. Pat. No. 4,483,049, the vials fracture when severely contacted by a tool, such as a screw driver, that typically would be used in an attemp to pry apart the opposing components of the device so that the device could be removed from the protected article. The vials are so disposed in the device as to be readily contacted by a tool being used to pry apart the object and thereby fracture to release the detrimental substance onto an protected article locked to the device.

In the device described in U.S. Pat. No. 4,670,950, the frangible vials are longitudinally disposed in the two opposing elongated components so that when either component is flexed longitudinally during an attempt to pry the two components apart, the vial contained therein fractures to release the detrimental substance onto an protected article locked to the device.

In the device described in U.S. Pat. No. 4,649,397, two frangible vials are longitudinally disposed in one of two opposing elongated components so that when such component is flexed longitudinally during an attempt to pry the two components apart, the vials contained therein fracture to release the detrimental substance onto an protected article locked to the device. Such device further contains an electronic article surveillance tag of the type described in U.S. Pat. No. 4,481,428 to Lincoln H. Charlot, Jr.

SUMMARY OF THE INVENTION

The theft-deterrent device of the present invention includes means for attaching the device to a article to be protected, with said attaching means being embodied in two components that are adapted to be locked together on opposite sides of a portion of said article to prevent unauthorized removal of the device from the article; wherein one component includes a plurality of fragile elongated vials that fracture when flexed longitudinally, with each vial containing a detrimental substance that would damage the article if the vial were to be fractured while the device was attached to the article; wherein the vial-containing component is so structured as to include a plurality of regions in which the vial-containing component flexes more easily in a predetermined direction than in other directions and regions, with the predetermined direction of easier flexing being different in different said given regions; and wherein said vials are respectively disposed within each of the given regions of the vial-containing component such that when any of the given regions of the vial-containing component is flexed in the predetermined direction of easier-flexing for said given region, the vial disposed in said region is flexed longitudinally and fractures to thereby release the substance contained therein.

In one aspect of the present invention, the other component is so structured as not to flex when an attempt is made to pry the vial-containing component from the other component while the two components are locked together, thereby concentrating flexure forces resulting from said prying in the vial-containing component.

In another aspect of the present invention, the vial-containing component includes a flexible member, which in each said easier-flexing region defines an elongated chamber that confines the vial, a pair of directional voids extending laterally from opposite sides of the chamber, and additional voids that define stiffened regions adjacent the chamber for directing forces applied to the flexible member by a tool being used in an attempt to pry the vial-containing component from the other component while the two components are locked together, such that said directed forces are concentrated across the directional voids of at least one of said easier-flexing regions to so flex the one easier-flexing region adjacent the chamber of said one easier-flexing region as to longitudinally flex and fracture the vial confined in the chamber of said one easier-flexing region.

In a further aspect of the present invention, the vial-containing component includes means for recessing the vials from an exposed surface of the flexible member to prevent the vials from being fractured during normal handling.

In still another aspect of the present invention, the theft-deterrent device further comprises shock absorbing means disposed in the chambers adjacent the vials in order to prevent the vials from breaking during normal handling of the theft-deterrent device.

In yet another aspect, the theft-deterrent device of the present invention includes means for attaching the device to the article, with said attaching means being embodied in two components that are adapted to be locked together on opposite sides of a portion of said article to prevent unauthorized removal of the device from the article; wherein one component includes a fragile vial, with said vial containing a detrimental substance that would damage the article if the vial were to be fractured while the device was attached to the article; wherein the attaching means includes a pin located in the vial-containing component and a clutch contained within a housing located in the other of said components for grasping said pin; and wherein the other component contains means for shielding the clutch housing from penetration by a drilling tool.

Additional features of the present invention are described in relation to the description of the preferred embodiment.

BRIFF DESCRIPTION OF THE DRAWING

FIG. 2 illustrates the attachment of the theft-deterrent device of FIG. 1 to a protected article or clothing.

FIG. 3 is a top plan view of the flexible member included in the first component of the theft-deterrent device of FIG. 1.

FIG. 4 is a bottom plan view of the flexible member included in the first component of the theft-deterrent device of FIG. 1, with the vials confined therein.

FIG. 5 is a bottom plan view of a flexible member included in the first component in an alternative preferred embodiment of the theft-deterrent device, with a torodial vial confined therein.

DESCRIPTION OF THE PREFERRED EMBODIMENT

Figure 1:
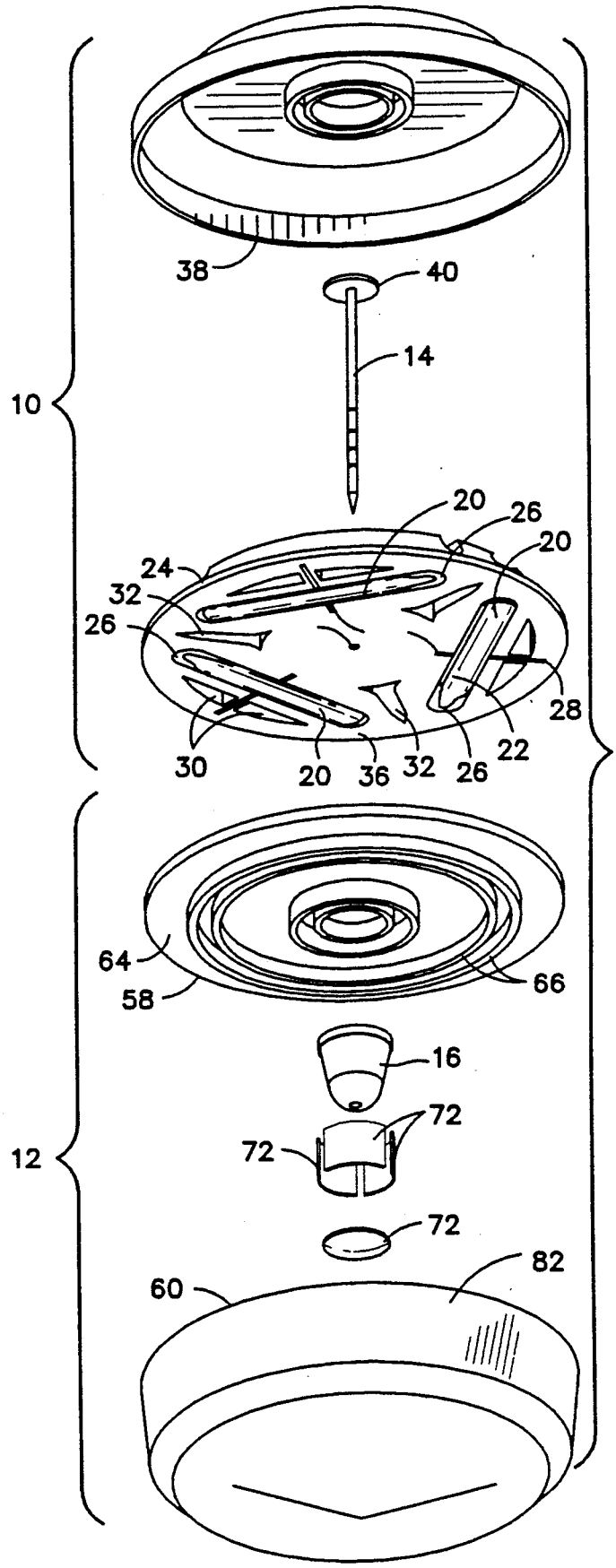
FIG. 1 is an exploded perspective view of a preferred embodiment of the theft-deterrent device of the present invention.

Referring to FIG. 1, a preferred embodiment of the theft-deterrent device of the present invention includes a first component 10 and a second component 12. The first component 10 includes a pin 14, and the second component 12 includes a clutch 16 for grasping the pin 14. The pin 14 is centrally located in the first component 10; and the clutch 16 is centrally located in the second component 16. The theft-deterrant device is attached to an article 18 to be protected (as illustrated in FIG. 2) by passing the pin 14 through a portion of the protected article 18 and engaging the pin 14 in the clutch 16 so that the clutch 16 grasps the pin 14. While the pin 16 is grasping the pin 14, the first component 10 and the second component 12 are locked together on opposite sides of a portion of the protected article 18 and thereby prevent unauthorized removal of the theft-deterrent device from the protected article 18.

The pin 14, the clutch 16 and the technique of releasing the pin 14 from the grasp of the clutch 16 so that the first component 10 can be unlocked from the second component 12 to thereby detach the protected article 18 from the theft-deterrent device are described in U.S. Pat. No. 4,523,356 to Lincoln H. Charlot, Jr.

Referring to FIGS. 3 and 4, the first component 10 includes three fragile elongated vials 20 that fracture when flexed longitudinally. Each vial 20 contains a detrimental substance 22 that would damage the protected article 18 if the vial were to be fractured while the theft-deterrent device was attached to the article 18. The detrimental substance 22 preferably is a fluid colored dye or permanent ink.

The first component 10 includes a flexible member 24 that contains the vials 20. The vials 20 are uniformly disposed about the pin 14 in regions of the flexible member 24 that are so structured as to flex more easily in a longitudinal direction with respect to the elongated vial 20 respectively disposed therein than in other directions and regions. The flexible member 24 is made of plastic and structured so that the vials 20 disposed therein are oriented in different directions, and so that the corresponding direction of easier flexing of the flexible member 24 is different in each of the easier-flexing regions. Accordingly, the vials 20 are respectively disposed within the easier-flexing regions of the flexible member 24 such that when any of the easier-flexing regions is flexed in a longitudinal direction with respect to the vial 20 disposed in such region, the vial 20 disposed in such region is flexed longitudinally and fractures to thereby release the detrimental substance 22 contained in the vial 20.

Each of the easier-flexing regions of the flexible member 24 defines an elongated chamber 26 that confines the vial 20. The flexible member 24 also defines a pair of directional voids 28 extending laterally from opposite sides of the chamber 26, and additional voids 30, 32 that define stiffened regions adjacent the chamber 26 for directing forces applied to the flexible member 24 by a tool being used in an attempt to pry the first component 10 from the second component 12 while the two components are locked together, such that the directed forces are concentrated across the directional voids 28 of at least one of the easier-flexing regions to so flex the easier-flexing region of the flexible member 24 adjacent the chamber 26 at which the directed forces are concentrated, as to longitudinally flex and fracture the vial 20 confined in the chamber 26 of such one easier-flexing region.

The first component 10 also includes rubber shock absorbing cradles 34 for the vials 20 in order to prevent the vials 20 from being broken during normal handling of the theft-deterrent device.

The openings to the chambers 26 in the exposed surface 36 of the flexible member 24 are smaller than the vials 20 so as to recess the vials from the exposed surface 36 and thereby prevent the vials 20 from being fractured during normal handling.

The first component 10 further includes a cover 38 into which the pin 14, and the flexible member 24 containing the vials 20 are fitted. The head 40 of the pin 14 is held between the cover 38 and the flexible member 24; and the pin 14 passes through a hole 41 in the flexible member 24. The flexible member 24 is ultrasonically welded to the cover 38 at the circumferential edge of the flexible member 24.

In an alternative embodiment, as illustrated in FIG. 5, the first component 10 includes a single toroidal vial 42 confined by a flexible member 44 instead of the three vials 20 and the flexible member 24. The toroidal vial 42 is uniformly disposed about a centrally located hole 46 through which the pin 14 passes. The vial 42 contains a detrimental fluid. The vial 42 is fragile and fractures when flexed longitudinally with respect to its circular longitudinal axis. The flexible member 44 is made of plastic and defines a circular elongated chamber 48 that confines the vial 42. The flexible member 46 also defines three pairs of directional voids 50 uniformly disposed about the chamber 48 confining the vial 42 and extending laterally from opposite sides of the chamber 48, and additional voids 52, 54 that define stiffened regions adjacent the chamber 48 for directing forces applied to the flexible member 44 by a tool being used in an attempt to pry the first component 10 from the second component 12 while the two components are locked together, such that the directed forces are concentrated across the directional voids 50 of at least one of three easier-flexing regions to so flex the region of the flexible member 44 adjacent the chamber 48 in the one of the easier-flexing regions at which the directed forces are concentrated, as to longitudinally flex and fracture the vial 42. The circular vial 42 is cradled in the chamber 48 of the flexible member 44 by rubber shock absorbers to prevent fracture of the vial 42 during normal handling of the theft-deterrent device.

The opening to the chambers 48 in the exposed surface 56 of the flexible member 44 is smaller than the vial 42 so as to recess the vial from the exposed surface 56 and thereby prevent the vials from being fractured during normal handling.

The second component 12 is so structured as not to flex when an attempt is made to pry the first component 10 from the second component 12 while the two components are locked together, thereby concentrating flexure forces resulting from said prying in the flexible member 24 of the first component 10.

Figure 6:
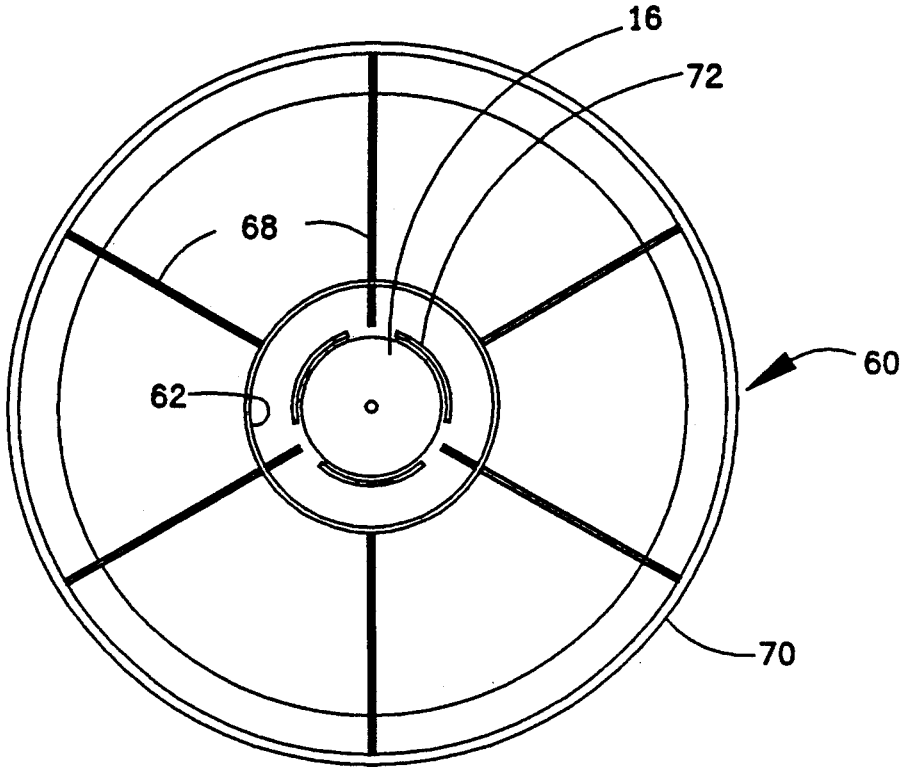
FIG. 6 is a top plan view of the barrel of the second component of the theft-deterrent device of FIG. 1.
Figure 7:
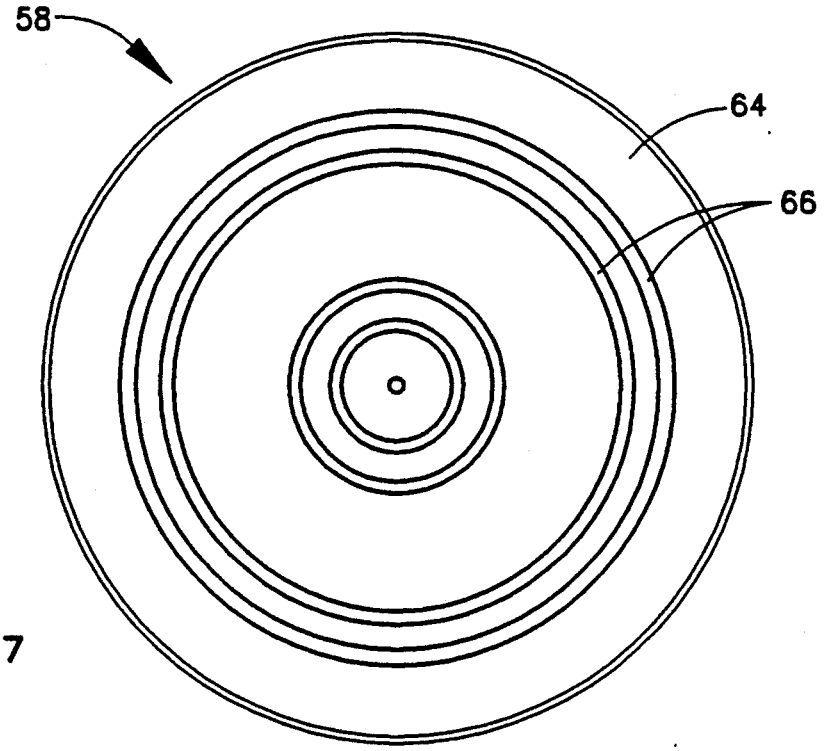
FIG. 7 is a bottom plan view of the cover of the second component of the theft-deterrent device of FIG. 1.

Referring to FIGS. 6 and 7, the second component 12 includes a cover 58 and a barrel 60. The barrel 60 includes a central chamber 62 that holds the housing of the clutch 16. In order to make the second component 12 rigid so that it does not flex, the concealed surface 64 of the cover 12 includes a plurality of circular stiffening ribs 66; and the barrel 60 includes a plurality of supporting struts 68 extending radially between the central chamber 62 and the outer wall 70 of the barrel 60.

The second component 12 also includes deflection plates 72 made of two-percent-carbon hardened spring steel, which line the central chamber 62 around the clutch 16 for deflecting the bit of a drill that one might use in an attempt to penetrate the housing of the clutch 16, and thereby shield the housing of the clutch 16 from a drilling tool.

The barrel 60 is ultrasonically welded to the cover 58 at the circumferential edge of the cover 58 and at the upper edge of the central chamber 62.

Figure 8:
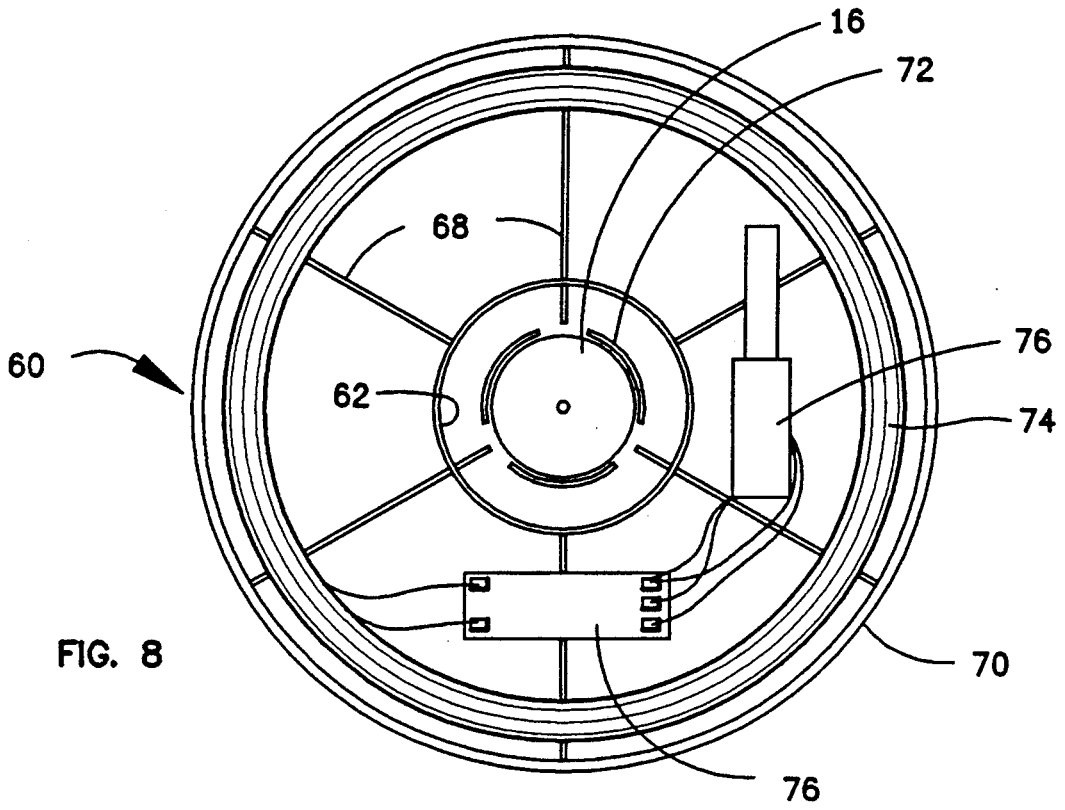
FIG. 8 is a top plan view of a barrel included in the second component in an alternative preferred embodiment of the theft-deterrent device, with an electronic article surveillance tag included in the barrel.

Referring to FIG. 8, in one preferred embodiment an electronic article surveillance (EAS) tag is contained within the second component 12. The EAS tag is thus isolated from the vials 20 containing the detrimental substance. The EAS tag is described in U.S. Pat. No. 4,481,428 to Lincoln H. Charlot, Jr. The EAS tag includes a relatively large coil 74 that is disposed just inside the wall 70 of the barrel 60 and smaller circuit elements 76 that are disposed in the spaces between the struts 68.

Figure 9A:
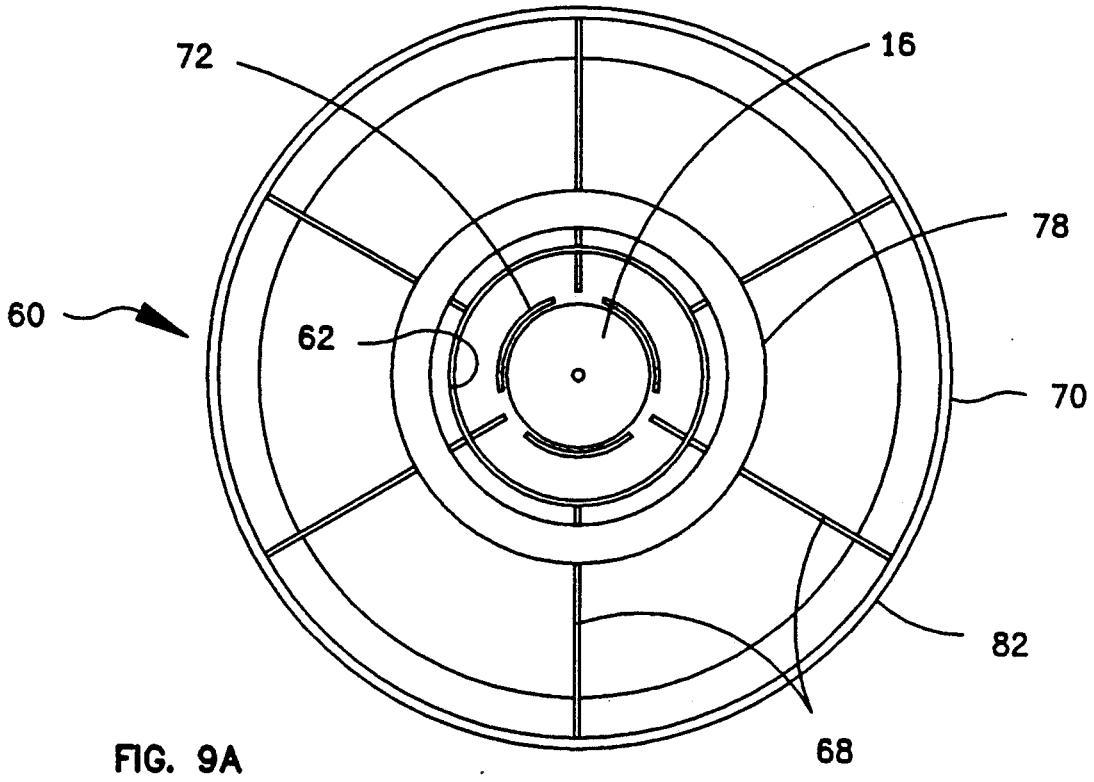
FIG. 9A is a top plan view of a barrel included in the second component in an alternative preferred embodiment of the theft-deterrent device, with a vial containing a detrimental substance included in the barrel.
Figure 9B:
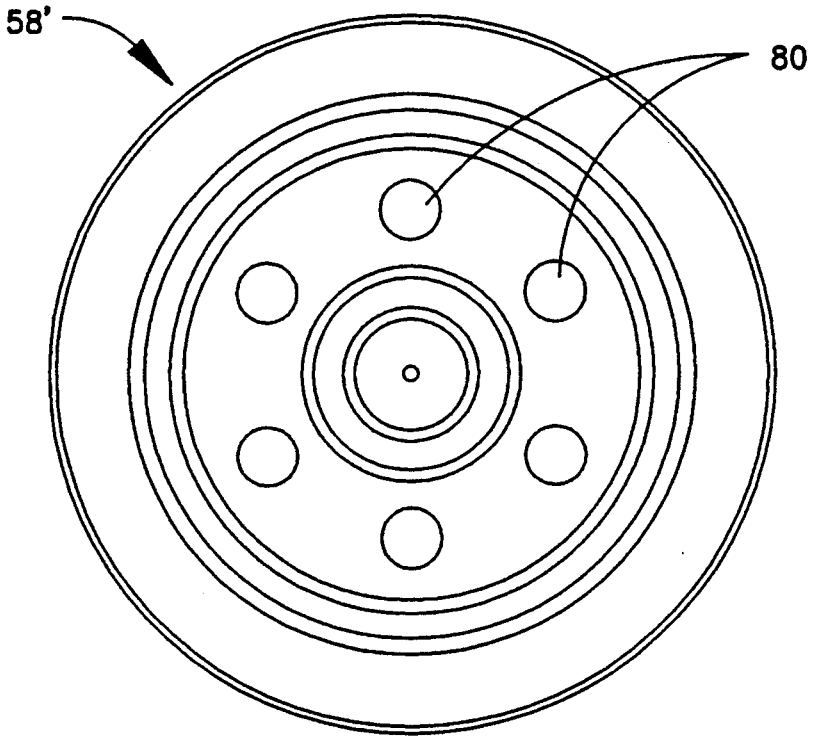
FIG. 9B is a bottom plan view of a cover included in the second component in the alternative preferred embodiment corresponding to FIG. 9B.

In an alternative embodiment, illustrated in FIGS. 9A and 9B, the second component 12 includes a vial 78 disposed around the housing of the clutch 16. The vial 78 contains a detrimental fluid. The cover 58 and the barrel 60 house the vial 78 from contact with tools applied to the exterior of the second component 12 such that the vial 78 can be fractured only by first penetrating either the cover 58 or the barrel 60 of the second component 12. When the the tool used for such penetration contacts the vial 78, the vial 78 is fractured and releases the detrimental substance, such as a fluid colored dye or permanent ink, contained therein. The cover 58' contains holes 80 for channeling the detrimental substance released from the vial 78 when the vial 78 is fractured to the exterior surface 82 of the second component 12 that is positioned adjacent the protected article attached thereto. The vial 78 is cradled by shock absorbing material (not shown) to prevent breakage of the vial 78 during normal handling of the theft-deterrent device.

We claim:

1. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a plurality of fragile elongated vials that fracture when flexed longitudinally, with each vial containing a detrimental substance that would damage the article if the vial were to be fractured while the device was attached to the article;

wherein the vial-containing component is so structured as to include a plurality of regions in which the vial-containing component flexes more easily in a predetermined direction than in other directions and regions, with the predetermined direction of easier flexing being different in different said given regions; and wherein said vials are respectively disposed within each of the given regions of the vial-containing component such that when any of the given regions of the vial-containing component is flexed in the predetermined direction of easier-flexing for said given region, the vial disposed in said region is flexed longitudinally and fractures to thereby release the substance contained therein.

2. A device according to claim 1, wherein the other component is so structured as not to flex when an attempt is made to pry the vial-containing component from the other component while the two components are locked together, thereby concentrating flexure forces resulting from said prying in the vial-containing component.

3. A device according to claim 1, wherein the attaching means includes a pin centrally located in the vial-containing component and a clutch located in the other of said components for grasping said pin; and wherein the plurality of said easier-flexing regions are uniformly disposed about the pin.

4. A device according to claim 3, wherein there are three said easier-flexing regions.

5. A device according to claim 1, wherein the vial-containing component includes a flexible member, which in each said easier-flexing region defines an elongated chamber that confines the vial, a pair of directional voids extending laterally from opposite sides of the chamber, and additional voids that define stiffened regions adjacent the chamber for directing forces applied to the flexible member by a tool being used in an attempt to pry the vial-containing component from the other component while the two components are locked together, such that said directed forces are concentrated across the directional voids of at least one of said easier-flexing regions to so flex the one easier-flexing region adjacent the chamber of said one easier-flexing region as to longitudinally flex and fracture the vial confined in the chamber of said one easier-flexing region.

6. A device according to claim 1, wherein the vial-containing component includes means for recessing the vials from an exposed surface of the flexible member to prevent the vials from being fractured during normal handling.

7. A device according to claim 1, wherein the vial-containing component defines a plurality of chambers that respectively confine the vials; and wherein the device further comprises shock absorbing means disposed in the chambers adjacent the vials.

8. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a fragile elongated vial that fractures when flexed longitudinally, with said vial containing a detrimental substance that would damage the article if the vial were to be fractured while the device was attached to the article;

wherein the vial-containing component is so structured as to be more easily flexed in a predetermined direction in a given region than in other directions and regions;

wherein the vial is disposed within the given region of the vial-containing component such that when the vial-containing component is flexed in the predetermined direction, the vial is flexed and fractures to thereby release the detrimental substance contained therein; and wherein the vial-containing component includes a flexible member defining an elongated chamber that confines the vial, a pair of directional voids extending laterally from opposite sides of the chamber, and additional voids that define stiffened regions adjacent the chamber for directing forces applied to the flexible member by a tool being used in an attempt to pry the vial-containing component from the other component while the two components are locked together, such that said directed forces are concentrated across the directional voids to so flex the region of the flexible member adjacent the chamber as to longitudinally flex and fracture the vial.

9. A device according to claim 8, wherein the vial is a toroid; and wherein the flexible member defines a plurality of pairs of directional voids uniformly disposed about the chamber confining the vial.

10. A device according to claim 8, wherein the attaching means includes a pin centrally located in the vial-containing component and a clutch located in the other of said components for grasping said pin;

wherein the vial is a toroid uniformly disposed in relation to said pin; and wherein the flexible member defines a plurality of pairs of directional voids uniformly disposed about the chamber confining the vial.

11. A device according to claim 8, wherein the other component is so structured as not to flex when an attempt is made to pry the vial-containing component from the other component while the two components are locked together, thereby concentrating flexure forces resulting from said prying in the vial-containing component.

12. A device according to claim 8, wherein the vial-containing component includes means for recessing the vials from an exposed surface of the flexible member to prevent the vials from being fractured during normal handling.

13. A device according to claim 8, wherein the vial-containing component defines a chamber that confines the vial; and wherein the device further comprises shock absorbing means disposed in the chamber adjacent the vial.

14. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a fragile elongated vial that fractures when flexed longitudinally, with said vial containing a detrimental substance that would damage the article if the vial were to be fractured while the device was attached to the article;

wherein the vial-containing component is so structured as to be more easily flexed in a predetermined direction in a given region than in other directions and regions;

wherein the vial is disposed within the given region of the vial-containing component such that when the vial-containing component is flexed in the predetermined direction, the vial is flexed and fractures to thereby release the detrimental substance contained therein; and wherein the other component is so structured as not to flex when an attempt is made to pry the vial-containing component from the other component while the two components are locked together, thereby concentrating flexure forces resulting from said prying in the vial-containing component.

15. A device according to claim 14, wherein the attaching means includes a pin centrally located in the vial-containing component and a clutch located in the other of said components for grasping said pin;

wherein the vial-containing component is so structured as to include a plurality of said regions uniformly disposed about said pin that flex more easily than in other regions, with the predetermined direction of easier flexing being different in different said given regions; and wherein the vial-containing component includes a plurality of said vials respectively disposed within the given regions of the vial-containing component such that when the vial-containing component is flexed in any of the predetermined directions, at least one of the vials is flexed and fractures to thereby release the substance contained therein.

16. A device according to claim 14, wherein the vial-containing component includes means for recessing the vials from an exposed surface of the flexible member to prevent the vials from being fractured during normal handling.

17. A device according to claim 14, wherein the other component contains an electronic article surveillance tag.

18. A device according to claim 14, wherein the attaching means includes a pin centrally located in the vial-containing component and a clutch located in the other of said components for grasping said pin; and wherein the other component includes a second vial disposed around the clutch, with the second vial containing a detrimental fluid;

means for shielding the second vial from contact with tools applied to the exterior of the other component such that the second vial can be fractured only by penetrating the other component; and means for channeling the detrimental fluid from the second vial to the exterior of the other component should the second vial be fractured.

19. A device according to claim 14, wherein the attaching means includes a pin located in the vial-containing component and a clutch contained within a housing located in the other of said components for grasping said pin; and wherein the other component contains means for shielding the clutch housing from penetration by a drilling tool.

20. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a fragile elongated vial that fractures when flexed longitudinally, with said vial containing a detrimental substance that would damage the article if the vial were to be fractured while the device was attached to the article;

wherein the vial-containing component is so structured as to be more easily flexed in a predetermined direction in a given region than in other directions and regions;

wherein the vial is disposed within the given region of the vial-containing component such that when the vial-containing component is flexed in the predetermined direction, the vial is flexed and fractures to thereby release the substance contained therein;

wherein the vial-containing component defines a chamber that confines the vial; and wherein the device further comprises shock absorbing means disposed in the chamber adjacent the vial.

21. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a fragile vial, with said vial containing a detrimental substance that would damage the article if the vial were to be fractured while the device was attached to the article;

wherein the attaching means includes a pin located in the vial-containing component and a clutch contained within a housing located in the other of said components for grasping said pin; and wherein the other component contains means for shielding the clutch housing from penetration by a drilling tool.

22. A device for deterring theft of a protected article, comprising means for attaching the device to the article, with said attaching means being embodied in two components that are adapted to be locked together on opposite sides of a portion of said article to prevent unauthorized removal of the device from the article;

wherein the attaching means includes a pin located in one of said components and a clutch located in the other of said components for grasping said pin; and wherein the other component includes a fragile vial disposed around the clutch, with the vial containing a detrimental substance that would damage the article if the vial were to be fractured by contact with tools applied to the other component while the device was attached to the article.

23. A device for deterring theft of a protected article, comprising means for attaching the device to the article, with said attaching means being embodied in two components that are adapted to be locked together on opposite sides of a portion of said article to prevent unauthorized removal of the device from the article;

wherein one component is flexible and includes a fragile vial that is disposed in said one component so that the vial fractures when the vial-containing component is flexed, with said vial containing a detrimental substance that would damage the article if the vial were to be fractured while the device was attached to the article; and wherein the other component is so structured as not to flex when an attempt is made to pry the vial-containing component from the other component while the two components are locked together, thereby concentrating flexure forces resulting from said prying in the vial-containing component.

24. A device according to claim 23, wherein the attaching means includes a pin located in one of said components and a clutch located in the other of said components for grasping said pin and thereby locking the two components together.

25. A device for deterring theft of a protected article, comprising means for attaching the device to the article, with said attaching means being embodied in two components that are adapted to be locked together on opposite sides of a portion of said article to prevent unauthorized removal of the device from the article;

wherein one component includes a fragile vial, with said vial containing a detrimental substance that would damage the article if the vial were to be fractured while the device was attached to the article;

wherein the one component including the fragile vial has a predominantly continuous exposed surface except for having at least one opening for enabling the detrimental substance to be released from the component upon the vial being fractured; and wherein each opening in the exposed surface is smaller than the vial so as to recess the vial from the exposed surface and thereby prevent the vial from being fractured during normal handling.

26. A device according to claim 25, wherein the opening is in a portion of the exposed surface that faces the other of the two components when the two components are locked together on opposite sides of a portion of said article.

* * * * *